US009011040B1

(12) United States Patent
Canepa

(10) Patent No.: US 9,011,040 B1
(45) Date of Patent: Apr. 21, 2015

(54) STAIR SCREED AND FLOAT DEVICE

(71) Applicant: Shawn Canepa, Sequim, WA (US)

(72) Inventor: Shawn Canepa, Sequim, WA (US)

( * ) Notice: Subject to any disclaimer, the term of this patent is extended or adjusted under 35 U.S.C. 154(b) by 0 days.

(21) Appl. No.: 13/957,721

(22) Filed: Aug. 2, 2013

Related U.S. Application Data

(60) Provisional application No. 61/679,352, filed on Aug. 3, 2012.

(51) Int. Cl.
*E01C 19/22* (2006.01)
*B05C 17/10* (2006.01)
*E01C 19/44* (2006.01)

(52) U.S. Cl.
CPC ..... *E01C 19/44* (2013.01)

(58) Field of Classification Search
CPC ..... B25G 1/06; B25G 1/102; B25G 1/04; B25G 1/00; E01C 19/24; E01C 19/402; E01C 19/44; E01C 19/40; E04F 21/24; E04F 21/16; E04F 21/241
USPC ..... 404/96, 97, 118; 15/235.4, 235.7, 15/235.8, 245.1, 144.1; 425/458
See application file for complete search history.

(56) References Cited

U.S. PATENT DOCUMENTS

| | | | | |
|---|---|---|---|---|
| 1,282,043 | A * | 10/1918 | Carr | 404/96 |
| 1,548,452 | A | 8/1925 | Fyhrie | |
| 2,179,563 | A * | 11/1939 | Sassano | 15/235.8 |
| 3,373,458 | A | 3/1968 | Haivala | |
| 3,947,916 | A | 4/1976 | Mitchell | |
| 4,080,684 | A | 3/1978 | Venditti | |
| 5,069,610 | A * | 12/1991 | Milburn | 425/87 |
| 5,524,316 | A * | 6/1996 | Johnson | 15/210.5 |
| 5,699,580 | A * | 12/1997 | Silverstein | 15/235.7 |
| 5,906,455 | A | 5/1999 | McLaughlin | |
| 6,308,370 | B1 * | 10/2001 | Southby | 15/245.1 |
| 8,079,842 | B1 * | 12/2011 | Tomasic | 425/173 |
| 8,832,898 | B1 * | 9/2014 | Stimach | 15/236.01 |
| 2007/0061989 | A1 | 3/2007 | Kalbach | |
| 2009/0178288 | A1 * | 7/2009 | Bahler | 33/518 |

FOREIGN PATENT DOCUMENTS

| | | | | |
|---|---|---|---|---|
| GB | 2234000 | A * | 1/1991 | E01C 19/52 |

OTHER PUBLICATIONS

Master Finish, Plasterer's Trowel, Sep. 14, 2009, p. 4.*

* cited by examiner

*Primary Examiner* — Abigail A Risic
(74) *Attorney, Agent, or Firm* — Virginia P. Shogren

(57) ABSTRACT

A combined stair screed and float device for quickly and efficiently spreading and smoothing wet concrete comprising a generally shoe shaped member with a vertically and horizontally adjustable top guide and base bar to rest on riser forms. In operation, a user rests the top guide and the base bar on two riser forms with a pointed corner finder floating over the concrete at the desired corner position. The user grasps a grip portion and a handle and guides the device across the tread in a simultaneous screed and float step preparing a smooth surface for finishing. The device is both vertically and horizontally adjustable to accommodate a full range of conceivable step heights, tread lengths, toe kick overhang lengths, and corners.

17 Claims, 4 Drawing Sheets

STAIR SCREED AND FLOAT DEVICE

CROSS REFERENCE TO RELATED APPLICATION

This application claims priority under 35 USC 119(e) of U.S. Provisional Patent Application Ser. No. 61/679,352 filed Aug. 3, 2012, entitled "Stair Screed and Float Device" by the same inventor, hereby incorporated by reference in its entirety.

FIELD OF THE INVENTION

The invention relates generally to tools for smoothing poured concrete, and more particularly, to a hand-held combined screed and float device to simultaneously smooth and flatten wet concrete tread surfaces typically defined by form stair stringers and risers.

BACKGROUND OF THE INVENTION

Finishing wet concrete to a smooth, even, flat surface is time and labor intensive. Creating a smooth surface is particularly important when pouring surfaces that will be walked on, such as floors, walkways, driveways and stair cases.

The first step in smoothing out poured concrete is to flatten the concrete using a "screed". A screed is typically a long, straight wooden board. The screed is dragged across the poured cement while simultaneously holding the board against the edges of the form. By repeating both sweeping and wriggling motions of the screed as it is passed over the concrete surface, areas of excess cement are pushed into lower points until the surface is sufficiently smooth. The screed is typically a 2 inch by 4 inch piece of lumber. While lumber is inexpensive, most pieces of lumber are slightly warped due to moisture and temperature, and as a result, are not straight-edged. The lumber can also be heavy and awkward to slide and push across the cement surface. The thick lumber also often catches on the wet surface and creates imperfections.

To avoid the problems with wood, some concrete finishers use aluminum screeds comprising straight lengths of aluminum with sharp edges. The aluminum is lighter to lift and move across the surface.

After the screed flattens the wet concrete, a second tool called a "float" may be used to push the surface and compress the concrete. Floats are typically large flat plates connected to handles. Floats are used, in particular, with concrete that has large pieces of aggregate. In the case of pure cement, floats help to not only squeeze water from the mix, but also to complete the smoothing out of the slab. Floats essentially consolidate a slab by pushing aggregates towards the center of the slab while bringing paste to the surface. Floats are typically constructed from wood or magnesium (referred to as a "mag float"). Magnesium floats are used, in particular, to close concrete surfaces when the concrete mix contains an air entraining admixture.

Creating smooth stair treads (stair steps) poses unique problems. Concrete stairways are typically formed by angled wooden stringers on both sides of the stair-well connected to spaced, vertically-oriented risers. Concrete is poured into the form. Because the angled stringers form the sides of each step, a traditional flat screed and/or float may not be used against the edges of opposing forms to smooth out and finish the stair treads. Instead, each stair tread must be separately smoothed out and finished by hand typically with use of a flat cement trowel.

Use of a trowel to smooth out each step is time and labor intensive due to the amount of cement that has to be smoothed out before the cement may be finished. In addition, the tool operator must hold the trowel and operate the trowel in close proximity to the wet cement surface for relatively long periods of time, which poses access problems when the stairway is lengthy or otherwise out of the close reach of the worker. In that event, the worker must wait for a series of steps to dry and harden before accessing additional steps to smooth out. The timing and difficulty of successive cement pourings adds expense and labor to the job. Alternately, the worker must erect a platform above the stairway upon which the worker may reach out and over each stair tread to smooth the tread out from above.

The base corners between the stair treads and the vertical risers of the next stair step also present a challenge to smoothing out and finishing the wet concrete. The corner should be continuous and smooth. The corner may be set back relative to the stair's toe kick (a small overhang on the outward edge of each stair tread). Forming a flat and smooth surface back to the corner is extremely difficult and usually requires labor intensive use of a hand-held trowel.

Concrete steps are designed in many different shapes and sizes, including curved stairways. As a result, the horizontal length of the stair tread, the vertical height of the stair step, and the shape of the corner differ from one project to the next. The height of each stair step is often determined by measuring the overall vertical height of the stairway and dividing that amount into equal step heights. Stair treads may be similarly determined by measuring the overall lateral distance for the stairway and dividing that amount into equal tread lengths. As a result, any particular stairway may have an entirely unique tread length and step height. The uniqueness of each project typically demands use of the labor and time intensive cement trowel.

Accordingly, there is an unmet need in the art for a combined screed and float device that does not require excessive labor to operate, that quickly and adequately smoothes stair tread wet concrete between stringers, that provides a continuous and clean corner edge between the tread and the riser of the next stair step, that is wide enough to provide a smooth surface and act as a float, but does not catch on the cement, leaving a smooth surface for finishing, and that is adjustable to any range of step heights, tread lengths, and corner shapes to accommodate any conceivable concrete stair project.

THE INVENTION

Summary of the Invention

The invention is a hand tool comprising a generally shoe-shaped member of a generally uniform diameter having a right face, a left face, a vertical axis, a horizontal axis, and a continuous peripheral edge defining an ankle margin and a heel margin at a distal end, a toe margin at a proximal end, and a base margin between the heel and toe margins. A pair of opposing spaced vertically-oriented elongated adjustment apertures are formed within the member proximate the ankle margin. A horizontally-oriented elevation guide of a defined length and second uniform diameter having an elongated slot aperture defined therein, is adjustably retained flush against the right or left faces of the shoe-shaped member proximate to, and generally parallel to, the ankle margin. The elevation guide is capable of slidable adjustment and retention against the shoe-shaped member along the vertical axis at a point of overlap between the slot aperture of the elevation guide, on the one hand, and the respective adjustment apertures formed within the shoe-shaped member, on the other hand. The distal end of the heel margin of the shoe-shaped member comprises a corner finder. At least one handle is attached to the member proximate the heel and base margins.

In operation, a user adjusts the elevation guide to a desired position that permits the user to rest the guide on a riser form, on the one hand, with the pointed tip of the corner finder positioned at the corner between the riser and the tread, on the other hand.

After adjusting the elevation guide to a desired position, a user sets the device down over a tread with the guide resting on top of the vertically-oriented riser form, on the one hand, and the base bar resting on the next vertically-oriented riser form, on the other hand. The corner finder floats over the wet concrete at the precise position desired for the corner. The user then grasps the toe margin with one hand and the handle, such as a knob, in the opposite hand, and guides the device across the length of the stair tread, thereby simultaneously smoothing and floating the concrete. Upon completion, a user may proceed directly to finishing the tread as desired, including through trowel work and/or texturing with brushes, brooms, and the like.

BRIEF DESCRIPTION OF THE DRAWINGS

The invention is described in more detail with reference to the attached photographs and drawings, in which.

DETAILED DESCRIPTION

The following detailed description illustrates the invention by way of example, not by way of limitation of the scope, equivalents or principles of the invention. This description describes several embodiments, adaptations, variations, alternatives and uses of the invention.

In this regard, the invention is illustrated in the several figures, and is of sufficient complexity that the many parts, interrelationships, and sub-combinations thereof cannot be fully illustrated in a single patent-type drawing. For clarity and conciseness, the drawings may show in schematic, or omit, parts that are not essential in that figure to a description of a particular feature, aspect or principle of the invention being disclosed. Thus, the best mode embodiment of one feature may be shown in one figure, and the best mode of another feature will be called out in another figure.

A. Stair Screed and Float Device

The invention comprises a device constructed from a generally unitary, shoe-shaped member having a curved and tapered toe margin defined by a hand hold, a flat base margin that may further be defined by a base bar, a heel margin defined by a tapered corner finder, and a horizontally-oriented top ankle margin. A top adjustment assembly comprises a rectangular shaped elevation guide with elongated adjustment aperture formed therein. The adjustment aperture is positioned perpendicular to spaced vertically-oriented elongated adjustment apertures formed within the body of the member. Where the device includes a base bar, a bottom adjustment assembly is positioned proximate the base margin of the device. A generally circular knob is positioned on both sides of the member for gripping.

In general, the combined Stair Screed and Float Device permits quick and efficient spreading and smoothing of wet concrete on a stair tread. The device provides a continuous and clean corner edge between the tread and the riser of the next stair step. The device is wide enough to provide a smooth surface and act as a float, and does not catch on the concrete, thereby leaving a smooth surface for finishing. The device is both vertically and horizontally adjustable to accommodate a full range of conceivable step heights, tread lengths, and corners.

Figure 1:
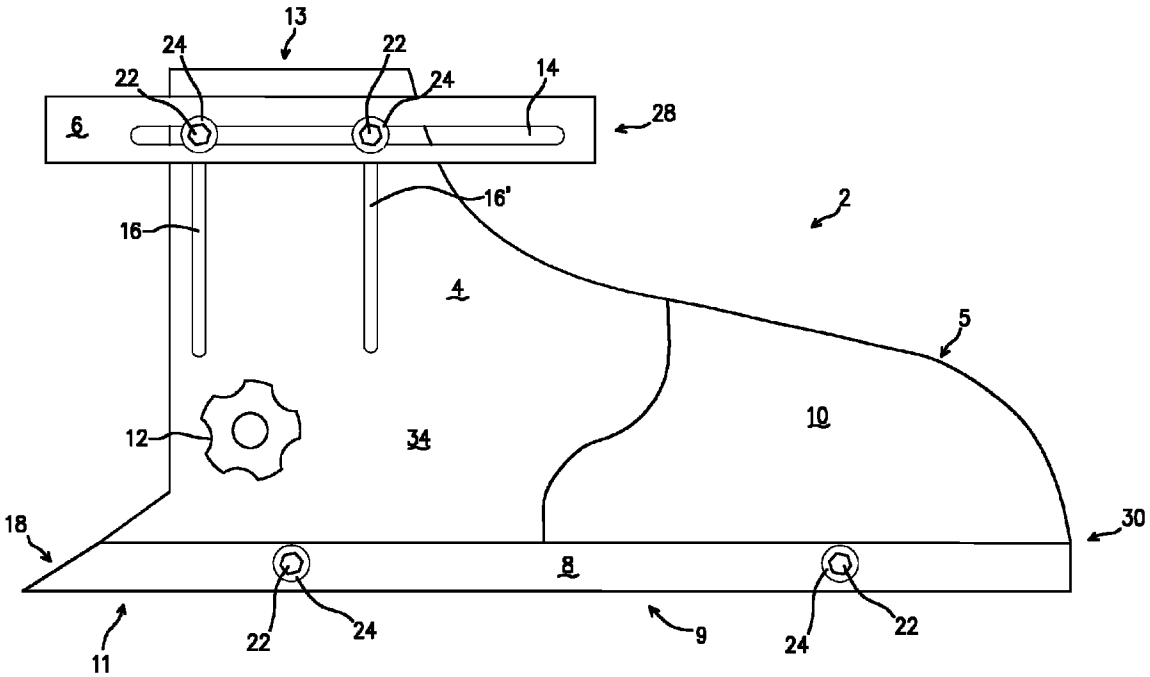
FIG. 1 is a left side plan view drawing of an exemplary Stair Screed and Float Device.

FIG. 1 shows the left face 34 of an exemplary Stair Screed and Float Device ("device") 2. As shown in FIG. 1, the device 2 comprises a generally unitary, shoe-shaped member 4 having a curved and tapered toe margin 5 defined by a hand hold 10, a flat base margin 9 defined by a base bar 8, a pointed heel margin 11 defined by a generally triangular-shaped corner finder 18, and a horizontally-oriented top ankle margin 13. Proximate and generally parallel to the top ankle margin 13 is a horizontally-oriented top adjustment assembly 28 comprising a rectangular shaped elevation guide 6 with elongated adjustment aperture 14 formed therein. The adjustment aperture 14 is positioned perpendicular to spaced vertically-oriented elongated adjustment apertures 16, 16' formed within the body of the member 4.

Referring to FIG. 1, the elevation guide 6 may be retained in its horizontal position by a pair of spaced tightened bolts 22 and washers 24 inserted through the aperture 14 in the elevation guide 6 and apertures 16, 16' in the member 4. A bottom adjustment assembly 30 is positioned proximate the base margin 9 of the device 2. The bottom adjustment assembly 30 comprises the base bar 8, the corner finder 18, and a pair of spaced, tightened bolts 22 and washers 24. A generally circular knob with curved, outer depressions 12 shaped for both manual (palm plus fingers) and/or finger-tip gripping is positioned on the member 4 between the assembly 30 and the vertically-oriented adjustment apertures 16, 16'. The corner finder 18 extends outwardly past the distal edge of the ankle margin 13 and comprises a tapered edge on a top end and a bottom end flush and continuous with the base bar 8.

Figure 2:
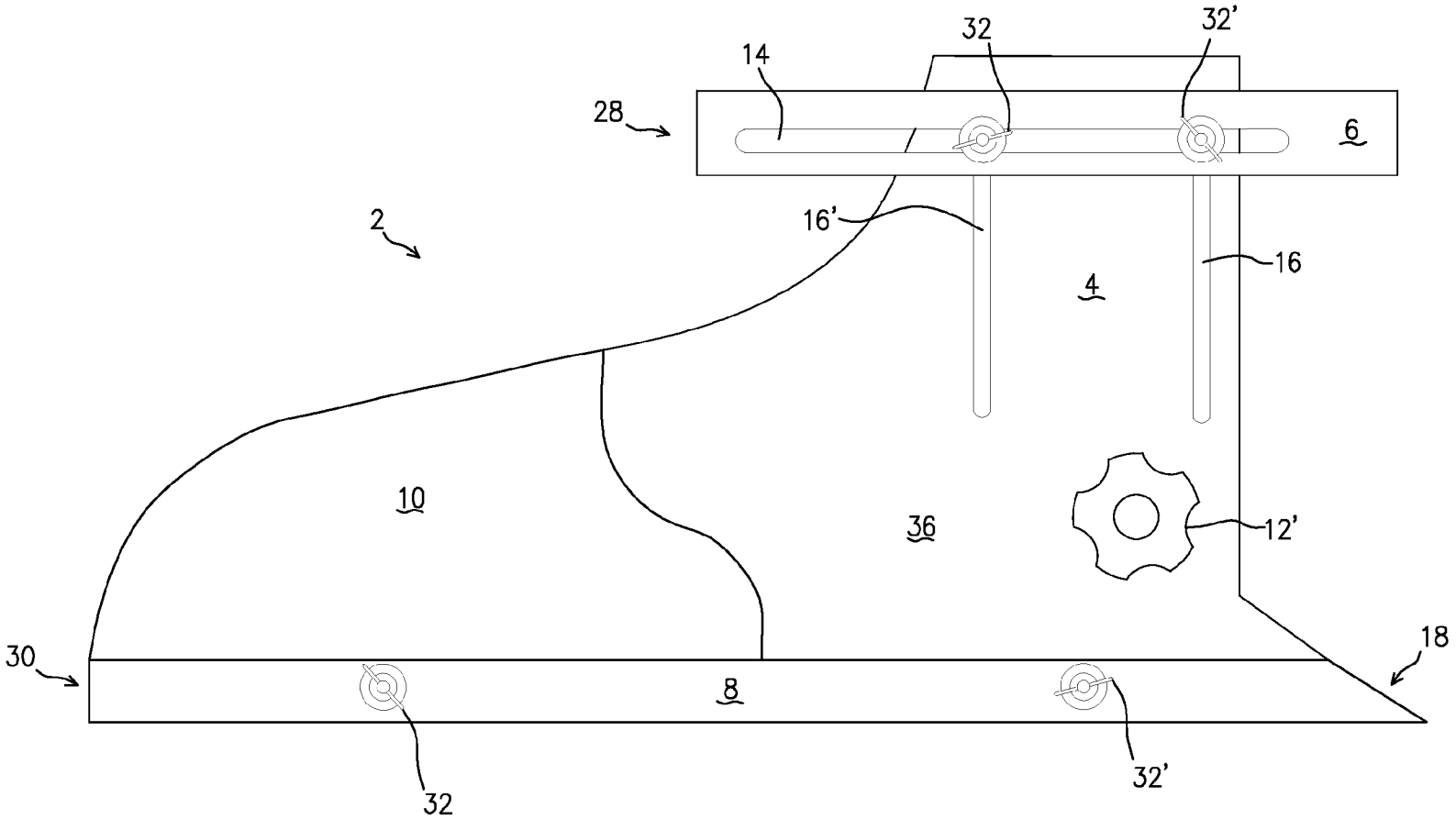
FIG. 2 is right side plan view drawing of an exemplary Stair Screed and Float Device.

FIG. 2 shows the right face 36 of the device 2. As shown in FIG. 2, the bolts 22 of the top adjustment assembly 28 are retained in position on the right face 36 within the overlapping apertures 14, 16/16' by a pair of spaced tightened wing nut screws 32, 32'. Likewise, the bolts of the bottom adjustment assembly 30 are retained in position by a pair of spaced, tightened wing nut screws 32, 32'. Referring to FIG. 2, the right face 36 of the device 2 also has a handle 12' protruding from the member 4 at the same position on the member 4 generally between the assembly 30 and the vertically-oriented adjustment apertures 16, 16'.

Figure 3B:
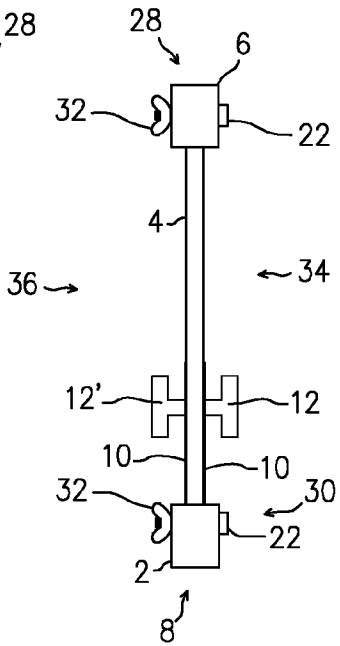
FIG. 3B is a rear plan view drawing of an exemplary Stair Screed and Float Device; and, FIG. 4 is a right side plan view drawing of an alternate embodiment of the Stair Screed and Float Device.
Figure 3A:
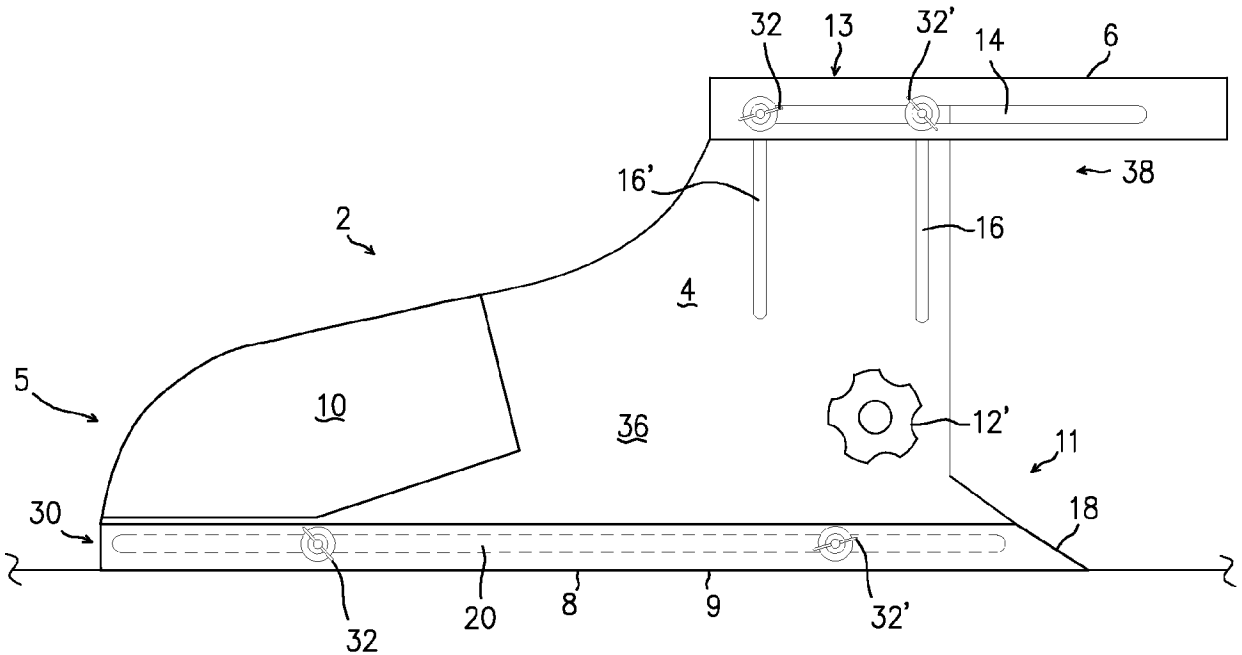
FIG. 3A is a right side plan view drawing of an exemplary Stair Screed and Float Device.

FIG. 3A shows a right plan view of the device 2, and FIG. 3B shows a rear plan view of the device 2. Referring to FIGS. 1-3B, the elevation guide 6 shown in FIGS. 1 and 2 is generally centered over the vertically-oriented adjustment apertures 16, 16'. In contrast, in FIG. 3A, the guide 6 is slid to its maximum distal position behind the device 2 and over the corner finder 18. The handle 12 for the device 2 shown in FIG. 3A is shown removed from the member 4 with a screw hole 26 formed within the member 4 for mounting the handle 12.

Referring again to FIG. 3A, a horizontally oriented elongated base adjustment aperture 20 is shown in dashed lines formed within, and defined by, the member 4. The base bar 8 may be removed and replaced with a longer base bar 8 (not shown) to accommodate projects with deep stair treads. Alternately, the base bar 8 may be constructed with a slot opening formed within a top margin to permit slidable adjustment of the base bar 8 around and along the base margin 9 of the member 4. Once a desired position of the base bar 8 relative to the member 4 is achieved, the base bar 8 is retained in position via bolts 22 (shown in FIG. 3B) extending through the aperture 20 and corresponding holes formed in the base bar 8 tightened by wing nut screws 32/32'.

Any suitable or desired materials may be used in the construction of the various components of the device 2. For example, the hand hold 10 may be a textured rubberized material, textured plastic, or covered in any material that induces a more firm grip. The member 4 may be constructed from aluminum, aluminum sheet metal, plastics, wood, composites, and the like. The elevation guide 6, base bar 8 and corner finder 18 may be constructed from aluminum, aluminum sheet metal, plastic, magnesium, or other suitable or desired materials or combinations thereof.

A preferred maximum horizontal dimension (length) of the device 2 is 18 inches, a preferred overall height is 9 inches, a preferred length of the ankle margin 13 is 4 inches, and a preferred length of the elevation guide 6 is 9 inches. A preferred diameter of the member 4 is 0.25 inches. A preferred diameter of the elevation guide 6 is 0.75 inches. However, it should be understood that any suitable or desired dimensions may be utilized for any components.

In addition, a logo design and/or other trademark (not shown) may be printed and/or embossed on the member 4 or at any other suitable or desired location on the device 2. The design(s) or other trademark(s) may be visible on the device 2 through printed words, printed designs, embossed words, embossed designs, and/or shaped margins.

B. Method of Use and Operation

In general, the device 2 is used to screed and/or float wet concrete poured into forms to form flat, smooth stair treads. Referring to FIGS. 1-3B, in operation, a user (not shown) adjusts the top adjustment assembly 28 to a desired position by loosening the wing nut screws 32/32' and sliding the elevation guide 6 vertically (via apertures 16, 16') and/or horizontally via aperture 14. The desired position of the guide 6 would permit the user to rest the guide 6 on a riser form, on the one hand, with the pointed tip of the corner finder 18 positioned at the corner between the riser and the tread, on the other hand. The horizontal adjustment of the guide 6 allows for use of the device 2 on varying widths and sizes of riser forms, as well as steps having various lengths of toe kicks. The vertical adjustment of the guide 6 allows for use of the device 2 on various heights of riser forms.

Referring again to FIGS. 1-3B, after adjusting the guide 6, a user may further adjust the bottom assembly 30 by sliding the base bar 8 relative to the member 4 to a new position, or by removing the base bar 8 altogether and replacing it with an alternate base bar 8 of a shorter or longer length.

Referring to FIGS. 1-3B, after adjusting the top and bottom assemblies 28/30 to desired positions, a user sets the device 2 down over a tread (not shown) with a distal portion of the guide 6 resting on top of the vertically-oriented riser form, on the one hand, and a proximal portion of the base bar 8 resting on the next vertically-oriented riser form, on the other hand. The corner finder 18 floats over the wet concrete at the precise position desired for the corner.

Referring to FIGS. 1-3B, the user then grasps the hand hold 10 in one hand and one of the handles 12/12' in the opposite hand and guides the device 2 laterally across the length of the stair tread, thereby smoothing the concrete out. Upon reaching a stringer, the user may switch hands and reverse the direction of the device 2 and smooth the concrete out over the opposite direction. Because the device 2 is resting on riser forms—both at the guide 6 level and at the base bar 8 level—the user never has to lift the device 2 during operation. The smooth edge of the base bar 8 ensures flat and smooth concrete spreading over the entire tread combined with precise, accurate and smooth corner formation at the tip of the corner finder 18.

In addition, the weight and width of the base bar 8 serves the additional purpose of a float by pushing any aggregate down into the step while allowing smooth concrete to surface on the tread. Consequently, upon completion of the smoothing step, a user may proceed directly to finishing the tread as desired, including through trowel work and/or texturing with brushes, brooms, and the like.

C. Alternate Embodiments

Figure 4:
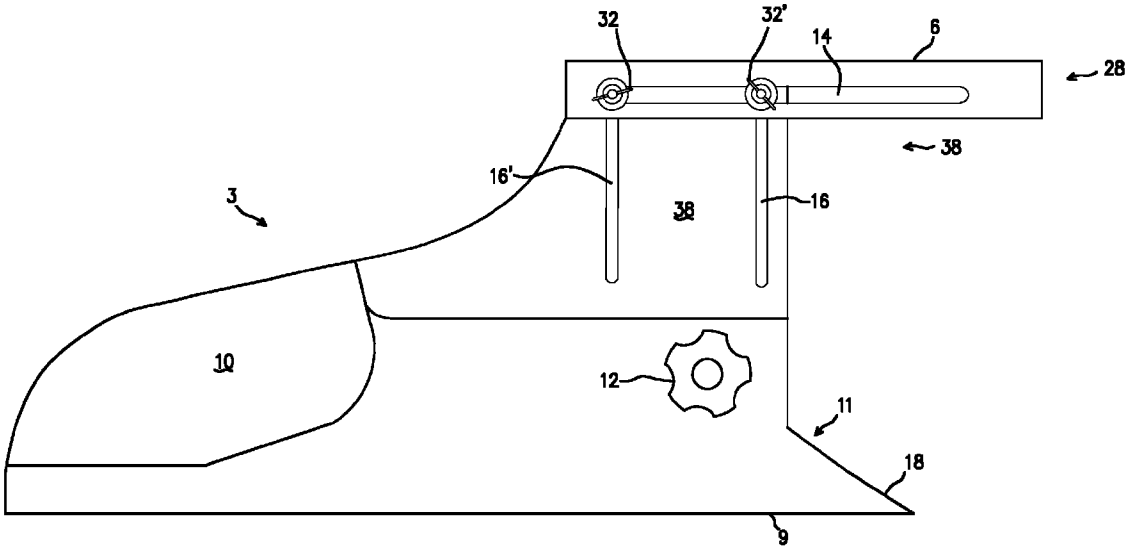

FIG. 4 shows an alternate embodiment of the device 3 constructed primarily from plastic materials. Referring to FIG. 4, the alternate embodiment 3 comprises an ankle portion 38 constructed from 0.25 inch wide plastic sheeting, and a guide 6 constructed from 0.75 inch wide plastic sheeting with a 0.25 inch wide top adjustment aperture 14 formed therein.

As shown in FIG. 4, the heel portion 11, base margin 9 and corner finder 18 are formed as one part without a base bar 8 or bottom adjustment assembly 30 (shown in FIGS. 1-3B). The entire heel/base margin/corner finder portion 11, 9, 18 may be formed from 0.75 inch wide plastic, or alternately, the base margin 9 may be flared to provide a wider base. It should be understood that any suitable or desired materials or dimensions for the heel 11, base margin 9, and/or corner finder 18 may be utilized. For example, at least a portion of the base margin 9 may comprise a layer of magnesium.

The device 3 shown in FIG. 4 constructed primarily from plastic materials is lighter to hold and less expensive to manufacture. As with the embodiment shown in FIGS. 1-3B, the device 3 shown in FIG. 4 has a top adjustment assembly 28 that is fully adjustable in two planes (horizontal and vertical) to accommodate a wide range of riser heights and tread depths.

It is clear that the Stair Screed and Float Device of this application has wide applicability to the concrete industry, namely to providing a single tool to efficiently and simultaneously screed and float wet concrete for any sized stair tread and riser height.

It should be understood that various modifications within the scope of this invention can be made by one of ordinary skill in the art without departing from the spirit thereof and without undue experimentation. For example, the corner finder 18 may be integral to the member 4 or supplemented by a complimentary corner finder 18 formed as part of the distal end of the base bar 8. The corner finder 18 may be shaped in any suitable or desired manner for a particular corner design, including tapered, triangular, protruding angles of various degrees, curved, or squared. The corner finder 18 may further be a separate part removable from the member 4 or base bar 8 and changeable as desired.

The adjustment of the guide 6 and base bar 8 may be achieved through any suitable or desired means, including screws, nuts, slidable catches, and the like. The guide 6 may be adjustably positioned and retained flush against the left 34 or right faces 36 of the member 4, or alternately, two guides 6/6' could be positioned flush against both the left 34 and right 36 faces of the member 4.

The handles 12/12' may be of any suitable or desired design for manual manipulation. While the handles 12/12' shown in FIGS. 1 and 2 are attached at generally opposing points on the left 34 and right 36 faces of the member 4 and comprise generally circular knobs with a series of curved outer depressions formed therein, the handles 12/12' could further or alternately be designed for attachment to a rod or extended handle for pushing or pulling the device 2/3. Alternately, the member 4 itself may further comprise means for attachment to a rod.

The hand hold 10 may comprise a material applied to any suitable or desired portion of the left 34 and/or right 36 faces of the member 4 proximate the toe margin 5, and/or the toe margin 5 itself. The toe margin 5 may, itself, be shaped for gripping by a user. The hand hold 10 and/or toe margin 5 may be texturized or shaped in any suitable or desired manner for increased gripping ability. This invention is therefore to be defined as broadly as the prior art will permit, and in view of the specification if need be, including a full range of current and future equivalents thereof.

I claim:

1. A hand tool, comprising:

a generally shoe-shaped member of a generally uniform diameter having a right face, a left face, a vertical axis, a horizontal axis, and a continuous peripheral edge defining an ankle margin and a heel margin at a distal end, a toe margin at a proximal end, and a base margin between the heel and toe margins;

a pair of opposing spaced vertically-oriented elongated adjustment apertures formed within the member proximate the ankle margin;

a horizontally-oriented elevation guide of a defined length and second uniform diameter, said elevation guide having an elongated slot aperture defined therein;

said elevation guide adjustably retained flush against the shoe-shaped member proximate to, and generally parallel to, the ankle margin;

said elevation guide capable of slidable adjustment and retention against the shoe-shaped member along the vertical axis at a point of overlap between the slot aperture of the elevation guide, on the one hand, and the adjustment apertures formed within the shoe-shaped member, on the other hand;

a horizontally-oriented elongated base aperture formed within the shoe-shaped member proximate the base margin;

a base bar capable of slidable secure adjustment and retention along the horizontal axis of the base margin;

said base bar comprising a corner finder at the distal end;

said base bar slidably retained against the base margin by a pair of spaced bolts and respective wing nut screws tightened against respective washers, said bolts extending through respective points of overlap between a pair of holes defined within the base bar, on the one hand, and the base aperture, on the other hand; and, at least one handle attached to the member.

2. The hand tool of claim 1, wherein the slidable retention of the elevation guide along the vertical axis is achieved through a first release and a subsequent tightening of a pair of spaced wing nut screws over a pair of respective bolts at the points of overlap.

3. The hand tool of claim 1, wherein the corner finder extends outwardly past the distal edge of the ankle margin and comprises a tapered edge on a top end and a bottom end flush and continuous with the base margin.

4. The hand tool of claim 1, comprising two handles attached at generally opposing points on the left and right faces of the member.

5. The hand tool of claim 1, wherein the handle comprises a generally circular knob with a series of curved outer depressions formed therein.

6. The hand tool of claim 1, wherein the handle comprises two knobs attached at generally opposing points on the left and right faces of the member, said knobs having a generally circular shape with a series of curved outer depressions formed therein.

7. The hand tool of claim 1, wherein the handle further comprises means for attachment to a rod.

8. The hand tool of claim 1, wherein the shoe-shaped member further comprises means for attachment to a rod.

9. The hand tool of claim 1, further comprising a hand hold material securely applied to at least a portion of the right and left faces of the shoe-shaped member proximate the toe margin.

10. The hand tool of claim 1, wherein at least a portion of the toe margin further comprises a hand hold material applied thereto, said hand hold material further shaped for gripping by a user.

11. The hand tool of claim 1, wherein the toe margin is shaped for gripping by a user.

12. The hand tool of claim 1, wherein a shape for the corner finder is selected from the group of: tapered, triangular, curved, and squared.

13. The hand tool of claim 1, wherein the shoe-shaped member is constructed primarily from aluminum sheet metal.

14. The hand tool of claim 1, wherein the shoe-shaped member is constructed primarily from plastic materials.

15. The hand tool of claim 1, wherein at least a portion of the base margin comprises magnesium.

16. The hand tool of claim 1, wherein at least a portion of said base bar is constructed from magnesium.

17. The hand tool of claim 1 wherein the uniform diameter of the member is 0.25 inches, and the second uniform diameter of the elevation guide is 0.75 inches.

* * * * *